US006123302A

United States Patent [19]

Taylor

[11] Patent Number: 6,123,302

[45] Date of Patent: Sep. 26, 2000

[54] LIQUID DISPENSING DEVICE AND METHODS UTILIZING A UNIAXIAL MOUNTING

[75] Inventor: Edward C. Taylor, Cumming, Ga.

[73] Assignee: Nordson Corporation, Westlake, Ohio

[21] Appl. No.: 09/183,518

[22] Filed: Oct. 30, 1998

[51] Int. Cl.[7] ..... A47B 96/06

[52] U.S. Cl. ..... 248/231.61; 222/105; 222/181.2; 248/230.5; 248/311.2

[58] Field of Search ..... 222/180, 181.1, 222/181.2, 181.3; 248/224.61, 222.14, 558, 102, 103, 106; 403/381, 299, 314, 353, 348, 349

[56] References Cited

U.S. PATENT DOCUMENTS

| | | | |
|---|---|---|---|
| 3,220,611 | 11/1965 | Zander et al. | 222/95 |
| 4,579,309 | 4/1986 | Fujiwara et al. | 248/311.2 |
| 4,964,543 | 10/1990 | Scheiber | 222/180 |
| 5,014,880 | 5/1991 | Loesel, Jr. et al. | 222/181 |
| 5,356,038 | 10/1994 | Banks | 222/96 |
| 5,406,996 | 4/1995 | Wagner et al. | 141/364 |
| 5,597,093 | 1/1997 | Lee | 222/113 |
| 5,775,654 | 7/1998 | Price | 248/231.61 |

OTHER PUBLICATIONS

Nordson Corporation, *Series H–200 Hot Melt Guns*, Brochure, Jun. 1998.

Nordson Corporation, *Nordson® H20 Series Automatic Hot Melt Guns*, Jun. 1990, 2 pgs.

Nordson Corporation, *Controlled Fiberization™ Technology*, Brochure, 1994, 1996.

*Primary Examiner*—Ramon O. Ramirez
*Assistant Examiner*—Tan Le
*Attorney, Agent, or Firm*—Wood, Herron & Evans, L.L.P.

[57] ABSTRACT

A uniaxial mounting for dispensing apparatus includes one or more uniaxial connecting portions on a dispenser and at least one support member having at least one complementary uniaxial mounting portion. The uniaxial mounting portions may include projections and generally complementary channels allowing rapid installation, removal and replacement of the dispenser. The support member may include a locking pivot for further adjustment capability. When dispensing heated liquids, a thermal insulator is incorporated to reduce heat conduction between the dispenser and the support member. The uniaxial mounting may have an alignment guide to ensure proper positioning of the dispenser along the axis of engagement between the uniaxial connecting portions.

21 Claims, 3 Drawing Sheets

LIQUID DISPENSING DEVICE AND METHODS UTILIZING A UNIAXIAL MOUNTING

FIELD OF THE INVENTION

The present invention relates generally to liquid dispensing apparatus and, more particularly, to mounting structures used to position liquid dispensers relative to a substrate.

BACKGROUND OF THE INVENTION

Conventional liquid dispensers spray or extrude liquids such as adhesives, sealants, caulks, coatings and paints onto a substrate. Often, the dispensers include a liquid distribution manifold which may or may not have attached on/off dispensing guns. In addition to the initial installation of the dispensers, service or plant personnel must routinely remove and replace the manifold and/or guns for various maintenance reasons or other purposes. Due to the large number of dispensers typical in a manufacturing environment, the time spent installing, removing and reinstalling the dispensers can be significant.

A conventional manner of mounting a liquid dispenser involves bolting the liquid distribution manifold to a mounting member. However, bolting the manifold to the mounting member requires significant installation and removal time, and limits repositioning options. In this latter regard, if a plurality of bolt positions are provided to create a more versatile mounting area, the unused bolt holes may corrode or become plugged with leaked fluids. Moreover, mounting surfaces with multiple bolt holes are more expensive to manufacture.

As another option, a liquid distribution manifold may be clamped to a mounting rod. Split clamps used on cylindrical rods, for instance, allow rotation of the attached dispenser equipment about the rod. While this allows additional position adjustments of the dispenser equipment, it can also increase the amount of time required to position and secure the equipment because the installer must maintain the desired position while securing the clamps. Clamping to other mounting surfaces can be similarly time consuming.

Heated liquids present additional problems relative to the mounting hardware of a dispenser. Specifically, heat conductive mounting hardware can conduct heat away from the dispensing equipment and thereby lower the liquid application temperature. Overall heating energy may be increased to counteract this effect, however, this wastes energy and increases costs. Additionally, metal mountings in these arrangements may be difficult to handle due to their elevated temperature. On the other hand, insulating materials used to thermally isolate the mounting hardware may provide inadequate strength and durability when used as force bearing mounting hardware.

Accordingly, there is a need for mounting structure that allows rapid installation and removal of a liquid dispenser in a desired position. There is a further need for mounting structure with thermal insulation characteristics which particularly benefit heated dispensing equipment.

SUMMARY OF THE INVENTION

To these ends, the invention provides liquid dispensing apparatus with a uniaxial mounting structure including first and second uniaxial connecting portions. The uniaxial mounting structure provides rapid, accurate and secure attachment for a liquid dispenser associated with the apparatus. The mounting is uniaxial in that the first uniaxial connecting portion slidably engages the second uniaxial connecting portion along a single axis. Contact surfaces or points between the two uniaxial connecting portions prevent motion in all directions except along the single axis.

More specifically, the apparatus comprises a liquid dispenser including a support portion having a first uniaxial connecting portion. The apparatus further includes a support member, which may be an arm or other type of support structure, having a mounting portion with a second uniaxial connecting portion. The second uniaxial connecting portion can slidably engage the first uniaxial connecting portion along a single linear axis. A locking member is provided for releasably securing the first uniaxial connecting portion to the second uniaxial connecting portion. In the preferred embodiment, the support portion of the liquid dispenser specifically comprises a liquid distribution manifold and the liquid dispenser further includes at least one dispensing gun connected for fluid communication with the liquid distribution manifold.

The first uniaxial connecting portion can include a projection, such as a dovetail boss, and the second uniaxial connecting portion can include a channel, such as a dovetail channel. Projections and channels having other shapes may be used to advantage as well. The locking member may be a threaded nut configured for releasable engagement against one of the first and second uniaxial connection portions. In another embodiment, the locking member may be a threaded bolt also configured for releasable engagement against one of the first and second uniaxial connection portions.

Air or other thermal insulation material may generally separate the dispenser and the support arm to lessen heat conduction between these components. The uniaxial connecting portions may incorporate such thermal insulation abilities in various manners. For example, the uniaxial connecting portions may contact each other at discrete locations leaving one or more thermally insulating air gaps. Alternatively, thermally insulating spacers or washers may thermally isolate the dispenser and the support arm.

Uniaxial mounting structure of this invention may be used on one or more locations of a liquid dispensing device. These locations may include top, rear, bottom or other sides of a dispenser component. In one desirable embodiment the dispenser component includes at least one integrally formed uniaxial connecting portion, such as a projection. In addition, the support member may advantageously include a pivot for providing additional adjustment capability. This pivot may also include a selectively engageable lock for positioning the dispenser at a desired annular orientation.

The invention further contemplates a method for mounting a liquid dispenser, such as a dispensing manifold and gun assembly, to a support. Consistent with the principles of this invention, the method generally comprises slidably engaging a first uniaxial connecting portion of the dispenser with a second uniaxial connecting portion of the support member along a single axis. The first uniaxial connecting portion is then secured to the second uniaxial connecting portion at a desired position with a locking member for preventing sliding movement between the first and second uniaxial connecting portions. Consistent with the description of the dispenser given above, it will be appreciated that such dispensers may include multiple dispensing components, such as guns and distribution manifolds.

Additional features, objects and advantages of the invention will become more readily apparent upon review of the following detailed description of the preferred embodiments taken in conjunction with the drawings.

DETAILED DESCRIPTION OF PREFERRED EMBODIMENTS

Figure 2:
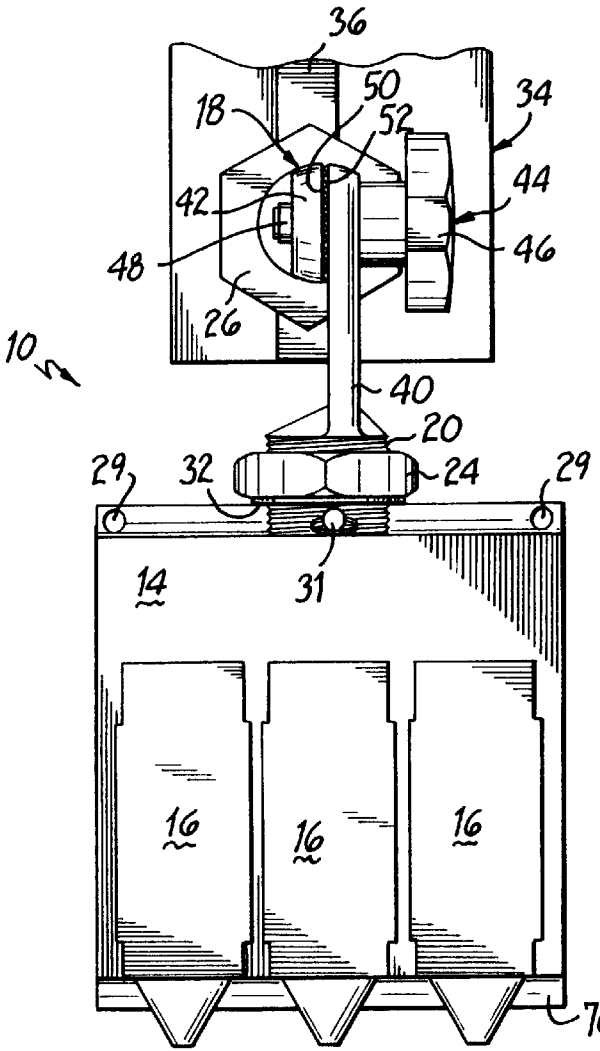
FIG. 2 is a front view of the embodiment shown in FIG. 1.
Figure 1:
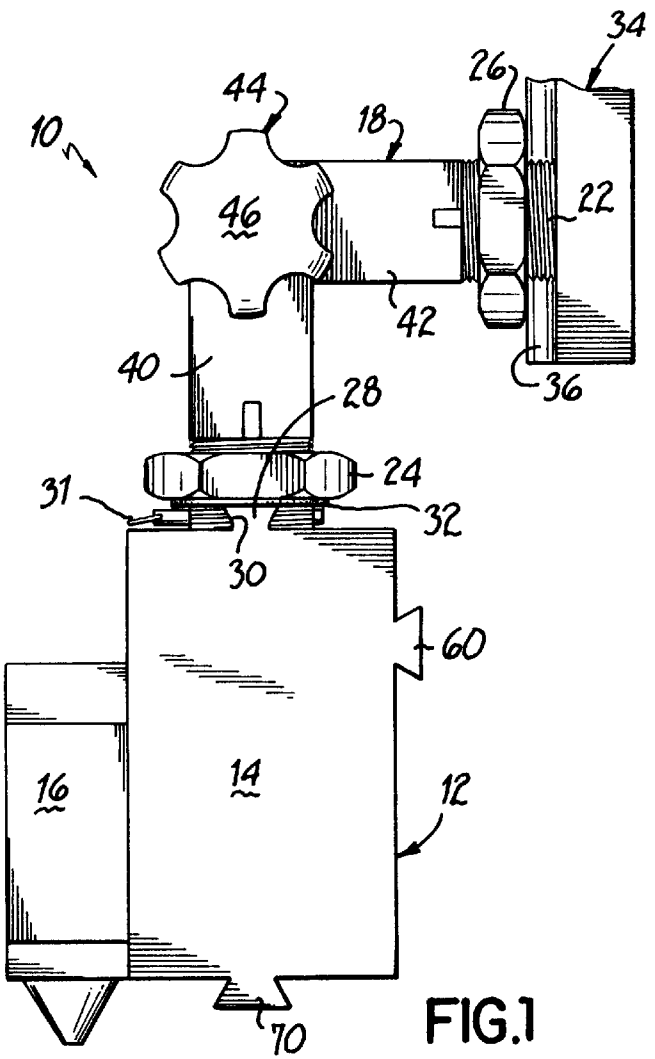
FIG. 1 is a side view of one embodiment of the invention showing the dispenser components mounted from a top side.

FIGS. 1 and 2 illustrate a liquid dispensing apparatus 10 mounted from a top side in accordance with one embodiment of the invention. Liquid dispensing apparatus 10 more specifically comprises a liquid dispenser 12, which may include multiple dispensing components such as a liquid distribution manifold 14 and a plurality of dispensing guns 16. Dispensing guns 16 may, for example, comprise Nordson Model H-200 guns available from Nordson Corporation, Westlake, Ohio. A conventional type of manifold 14 or service block may be connected for fluid communication with one or more dispensing guns 16 and may supply pressurized liquid and pressurized operating air to guns 16. Many types of liquids may be dispensed from apparatus mounted in accordance with the invention and these may include heated liquids such as thermoplastics or, more specifically, hot melt adhesives. While three dispensing guns 16 are shown in the drawings for illustration purposes, a greater or smaller number of guns 16 may be connected to manifold 14. Also, many types of single or multi-component dispensers may be mounted in accordance with the principles of this invention.

For providing a uniaxial mounting structure in accordance with the invention, apparatus 10 includes at least one support member which may be configured as an arm 18 having opposite threaded ends 20, 22 each receiving a respective lock member in the form of a threaded nut 24, 26. Other types of support members may alternatively be used with the only requirement being the provision of adequate support for the particular dispenser or dispensers. In the preferred embodiment, manifold 14 serves as a support portion of dispenser 12 and, for this purpose, includes a first uniaxial connecting portion in the preferred form of a projection 28. Threaded end portion 20 of support arm 18 also includes a complementary uniaxial connecting portion 30 in the preferred form of a channel of generally complementary shape to projection 28, e.g., a dovetail channel. Projection 28 may contain one or more holes 29 to serve as alignment guides with respect to a hole in threaded end portion 20 which contains a removable alignment pin 31. This allows a repeatable position to be quickly attained when installing or reinstalling dispenser 12. As will be appreciated from the description to follow, threaded end 22, which has the same uniaxial connection, may also incorporate this feature to allow repeatable positioning along a transverse axis, such as the vertical axis shown. While projection 28 and channel 30 are shown generally as dovetails, it will be understood that other shapes, such as rounded shapes or T-shapes, may be used as well. Combinations of different shapes for the projection and channel 28, 30 may be used and the locations of projection 28 and channel 30 may be reversed relative to dispenser 12 and arm 18.

Dovetail boss 28 may slidably engage dovetail channel 30 while positioning dispenser 12 as desired with respect to support arm 18. Once dispenser 12 is in position, the installer rotates nut 24 against a spacer or washer 32 positioned between nut 24 and dovetail boss 28 and thereby prevents sliding movement of dispenser 12. Spacer 32 may be formed from a thermally insulating material to lessen the amount of heat transferred between dispenser 12 and arm 18. End 22 of arm 18 is connected to additional mounting structure 34. This connection may be formed in any desired manner, however, in the preferred embodiment this connection is also made with a uniaxial mounting. In this regard, mounting structure 34 includes a uniaxial connecting portion 36 in the preferred form of a dovetail boss, while end 22 includes a complementary dovetail channel (not shown) which may slidably engage boss 36 until nut 26 is tightened against boss 36. The uniaxial connection at end 22 therefore operates identically to the connection at end 20 and may also be modified in with differently shaped uniaxial connecting portions as well. It should also be noted that the axes of engagement at ends 20 and 22, as between arm 18, manifold 14 and mounting structure 34 are transverse or, more specifically, orthogonal to each other. This, for example, allows for independent vertical and horizontal adjustment.

Support arm 18 more specifically comprises at least a pair of arm segments 40, 42 in the preferred embodiment. While this is not required for carrying out the invention, it allows the use of a pivot 44 to selectively rotate dispenser 12 with respect to mounting structure 34. A knob 46 operates to lock dispenser 12 at a desired angular orientation. Specifically, with reference to FIG. 2, locking knob 16 includes a threaded fastener portion 48 received by a pair of knurled or roughened arm portions 50, 52. When knob 46 is tightened, knurled arm portions 50, 52 will frictionally engage one another and lock arm segments 40, 42 in a particular orientation. Many other types of pivots and lock members may be substituted for this arrangement.

Figure 3:
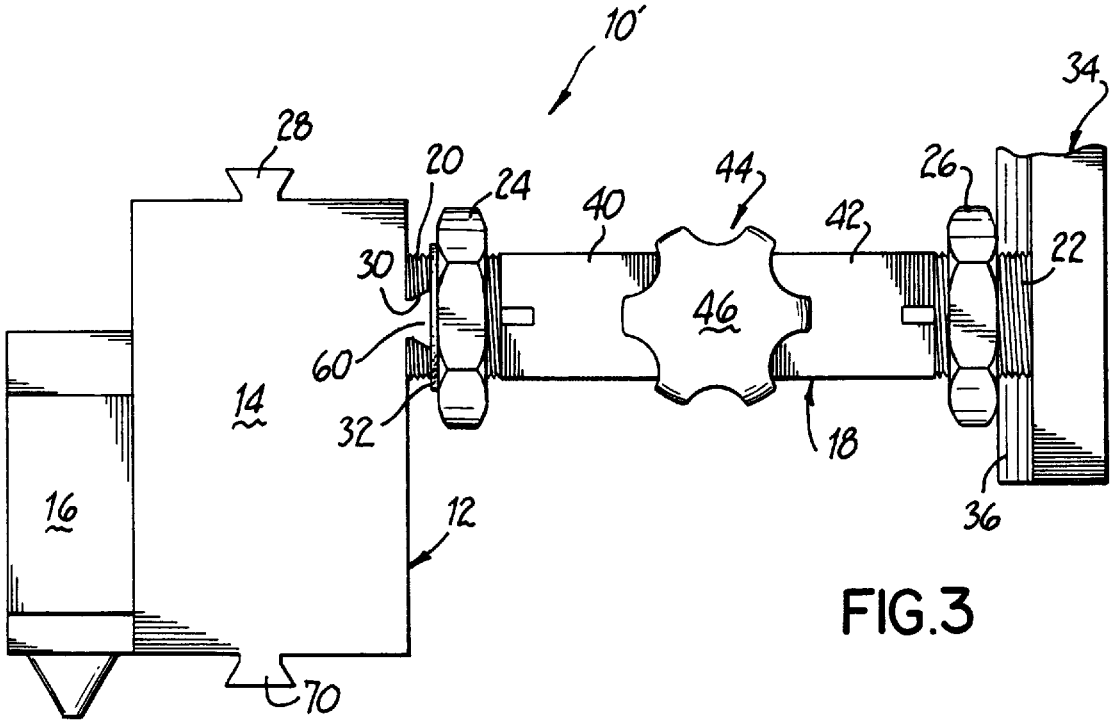
FIG. 3 is a side view of a second embodiment, showing the dispenser components mounted from a rear side.

Referring now to FIG. 3, a modified arrangement of a liquid dispensing apparatus 10' may include the same liquid dispenser 12 and support arm 18 as discussed above. However, support arm 18 is mounted to a rear uniaxial connecting portion 60 of manifold 14. Support arm 18 has also been straightened by unlocking pivot 44, adjusting arm segments 40, 42 in line with each other as shown, and relocking pivot 44. Ends 20, 22 of arm 18 are respectively connected to uniaxial connecting portion 60 of manifold 14 and uniaxial connecting portion 36 of mounting structure 34 as described with respect to FIGS. 1 and 2. This arrangement provides an added level of mounting versatility as required for certain applications.

Figure 4:
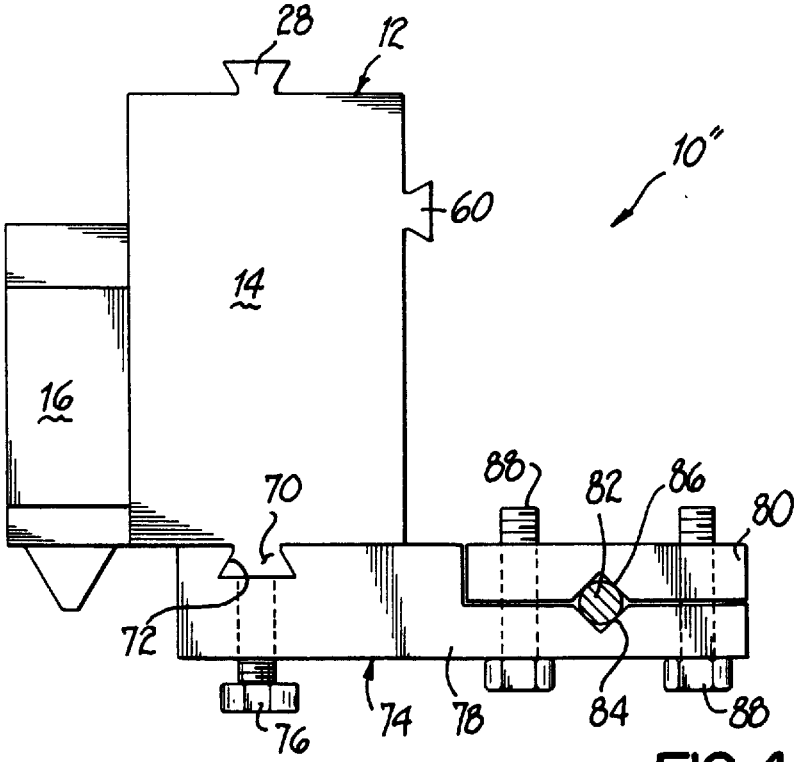
FIG. 4 is a side view showing a third embodiment with the dispenser components mounted from a bottom side.

Referring to FIG. 4, a liquid dispensing apparatus 10" constructed in accordance with an alternative arrangement uses a lower uniaxial connecting portion 70 of dispenser 12. Connecting portion 70 is shown as a dovetail boss or projection, although other uniaxial connecting portions may be used as discussed above. Dovetail boss 70 is received in a dovetail channel 72 formed within a support arm 74. In this embodiment, a locking member 76 in the form of a bolt is used to lock the uniaxial connecting portions 70, 72 together. As another of many possible support alternatives, support arm 74 includes a pair of arm segments 78, 80 clamped against a cylindrical rod 82. A pair of opposed channels 84, 86 in arm segments 78, 80 receive cylindrical rod 84 in a manner allowing sliding and rotational movement. Once support arm 74 is positioned at a desired location and orientation along and about rod 84, arm segments 78, 80 may be clamped tightly against rod 82 using multiple bolts 88. This provides yet another alternative, versatile mounting arrangement for dispenser 12 which allows for easy installation and removal along a bottom side, for example, after a one-time adjustment and fixation has been made relative to support arm 74. It will be appreciated that the adjustability features of support arm 74 may also be incorporated into mounting arrangements adapted for other sides of dispenser 12.

Figure 5:
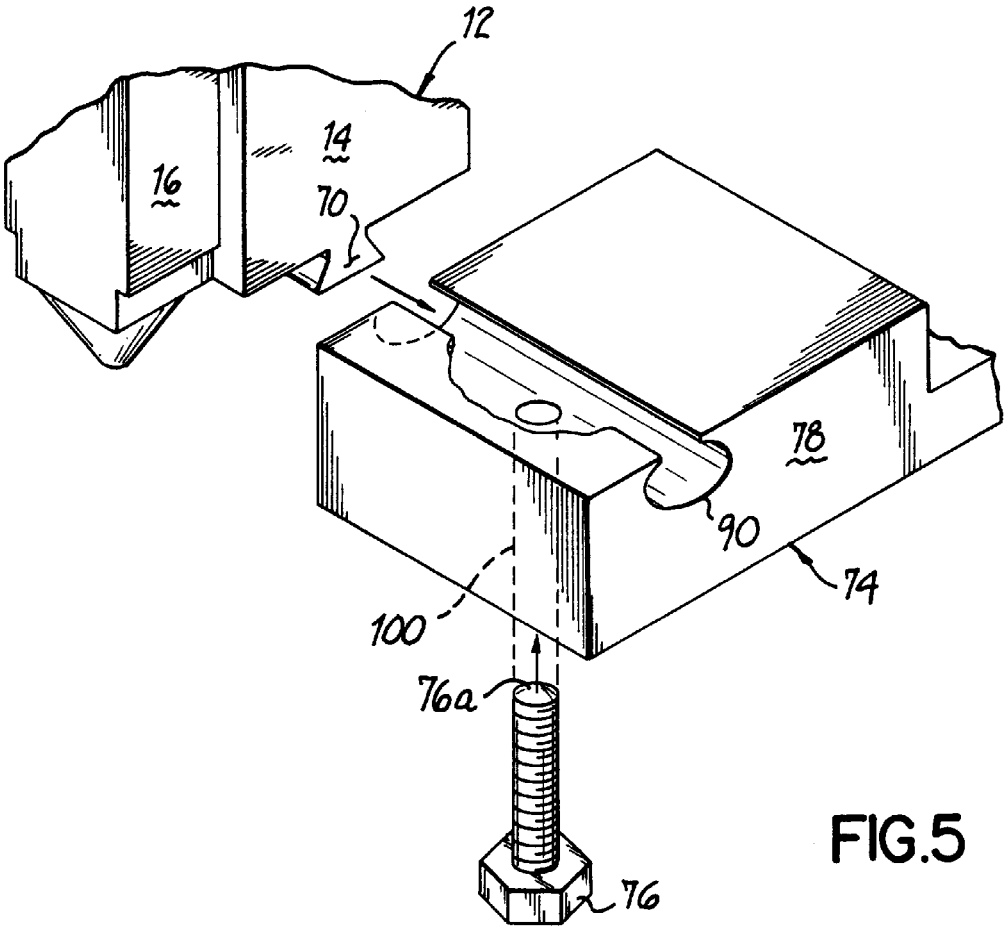
FIG. 5 is an exploded perspective view showing an alternative embodiment of the uniaxial connecting portions of the dispenser and support arm of FIG. 4.
Figure 6:
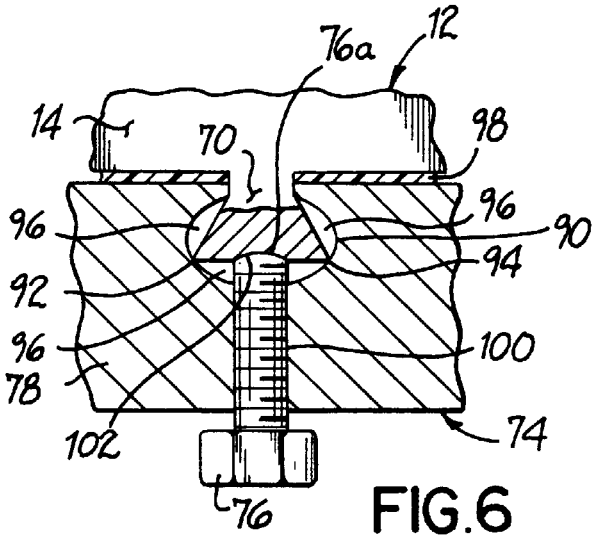
FIG. 6 is a cross sectional view showing the uniaxial connecting portions fixed together.

FIGS. 5 and 6 illustrate one alternative uniaxial mounting structure adapted to provide thermal insulation between dispenser 12 and a support arm, such as arm 74 shown in FIG. 4. More specifically, dovetail boss 70 may be received into a rounded channel 90 and makes contact at a plurality of discrete locations or points 92, 94 (FIG. 6). This creates at least one, and preferably a plurality of air gaps 96 for providing thermal insulation between support arm 74 and dispenser 12. As an additional level of thermal insulation, a thermally insulating spacer 98 may be situated between dispenser 12 or, more specifically, manifold 14 and support arm 74.

FIGS. 5 and 6 further illustrate one embodiment of an alignment guide incorporated into the mounting structure. As one form of an alignment guide used for locating dispenser 12 at a specific position with respect to support arm 74, bolt 76 may be threaded into hole 100 within arm segment 78 and an end 76*a* of bolt 76 may be received within a recess 102 contained in dovetail boss 70. Multiple recesses 102 may be provided along dovetail boss 70 for providing a plurality of discrete locations to positively receive bolt end 76*a* and thereby position dispenser 12 at one of a plurality of predetermined positions. It will further be appreciated that this is just one form of an alignment guide and many additional types of alignment guides may be used to physically or visually align the dispenser and supports associated with carrying out this invention.

While the present invention has been illustrated by a description of various embodiments and while these embodiments have been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known. However, the invention itself should only be defined by the appended claims, wherein

I claim:

1. Apparatus for dispensing a liquid adhesive material, the apparatus comprising:

a liquid adhesive dispenser including a support portion configured to receive a supply of the liquid adhesive material and a dispensing gun connected to said support portion to allow liquid adhesive communication with the support portion, said support portion having a first uniaxial connecting portion;

a support member having a mounting portion including a second uniaxial connecting portion configured to slidably engage the first uniaxial connecting portion along a single linear axis; and a locking member releasably securing the first uniaxial connecting portion to the second uniaxial connecting portion.

2. The apparatus of claim 1, wherein the support portion of the liquid dispenser further comprises a liquid distribution manifold and the liquid dispenser further includes a plurality of dispensing guns connected for fluid communication with the liquid distribution manifold.

3. The apparatus of claim 1, wherein the first uniaxial connecting portion includes a projection and the second uniaxial connecting portion includes a channel.

4. The apparatus of claim 1, wherein the first uniaxial connecting portion comprises a dovetail boss and the second uniaxial connecting portion comprises a dovetail channel.

5. The apparatus of claim 1, wherein the locking member comprises a threaded nut engageable against at least one of the first and second uniaxial connecting portions.

6. The apparatus of claim 1, wherein the support member is an arm having at least two arm segments and a selectively adjustable and lockable pivot connecting the two arm segments, said pivot adapted to set a desired angular relationship between the two arm segments.

7. The apparatus of claim 1, wherein the first uniaxial connecting portion contacts the second uniaxial connecting portion at a plurality of discrete contact surfaces with air spaces disposed between the contact surfaces to reduce thermal conduction between the dispenser and the support member.

8. The apparatus of claim 1, wherein the locking member is a threaded bolt and the second uniaxial connecting portion includes a bolt hole for receiving the bolt and allowing engagement thereof against the first uniaxial connecting portion.

9. The apparatus of claim 8, wherein the first uniaxial connecting portion includes a recess for receiving an end portion of the bolt and thereby locating the dispenser at a defined position.

10. The apparatus of claim 1, wherein the support member is configured to rotatably engage and selectively lock against a mounting rod allowing the dispenser to be rotated to a desired orientation and locked in place.

11. The apparatus of claim 1, wherein the first uniaxial connecting portion is integrally formed on an outer surface of the dispenser.

12. Apparatus for dispensing a liquid material, the apparatus comprising:

a liquid dispenser including a support portion, said support portion including multiple sides and a plurality of first uniaxial connecting portions respectively disposed on said multiple sides to allow optional connections to be made to each of said plurality of first uniaxial connection portions;

a support member having a mounting portion including a second uniaxial connecting portion configured to slidably engage one of the plurality of first uniaxial connecting portions along a single linear axis; and a locking member releasably securing the one of the plurality of first uniaxial connecting portions to the second uniaxial connecting portion.

13. The apparatus of claim 1 further including a spacer formed of a thermally insulating material and generally disposed between the dispenser and the support member for reducing thermal conduction therebetween.

14. The apparatus of claim 1 further comprising alignment guide elements connected with the dispenser and the support member for positively aligning the dispenser at a predetermined location.

15. The apparatus of claim 1, wherein said support member includes a third uniaxial connecting portion and the apparatus further comprises:

another support member having a fourth uniaxial connecting portion configured to slidably engage said third uniaxial connecting portion along another single linear axis; and a locking member releasably securing the third uniaxial connecting portion to the fourth uniaxial connecting portion.

16. The apparatus of claim 15, wherein the two single linear axes are transverse to each other.

17. A method for mounting a liquid adhesive dispenser to a support member, the liquid adhesive dispenser including a support portion configured to receive a supply of liquid adhesive material and a dispensing gun connected to said support portion to allow liquid adhesive communication with the support portion, the method comprising:

slidably engaging a first uniaxial connecting portion carried by the support portion with a second uniaxial connecting portion carried by the support member along a single axis; and securing the first uniaxial connecting portion to the second uniaxial connecting portion at a desired position with a locking member for preventing sliding movement between the first and second uniaxial connecting portions.

18. The method of claim 17 further comprising the step of thermally insulating the dispenser from the support member.

19. The method of claim 18, wherein the step of thermally insulating the dispenser from the support member includes providing at least one air gap between the first and second uniaxial connecting portions.

20. The method of claim 17, wherein the step of slidably engaging the first uniaxial connecting portion with the second uniaxial connecting portion further comprises:

referencing an alignment guide on one of the first and second uniaxial connecting portions to locate the dispenser at the desired location.

21. The method of claim 17, wherein the support member further includes a lockable pivot, and the method further comprises:

rotating a portion of the support member about the pivot to obtain an alternative position of the dispenser, and locking the pivot at the alternative position.

* * * * *